US006389859B1

(12) United States Patent
Paolini et al.

(10) Patent No.: US 6,389,859 B1
(45) Date of Patent: May 21, 2002

(54) MASTER/VALET KEYSET AND LOCK

(75) Inventors: Michael A. Paolini, Round Rock; Viktors Berstis, Austin, both of TX (US)

(73) Assignee: International Business Machines Corp., Armonk, NY (US)

( * ) Notice: Subject to any disclaimer, the term of this patent is extended or adjusted under 35 U.S.C. 154(b) by 0 days.

(21) Appl. No.: 09/522,195

(22) Filed: Mar. 9, 2000

(51) Int. Cl.[7] ..... E05B 35/10
(52) U.S. Cl. ..... 70/340; 70/338; 70/383
(58) Field of Search ..... 70/337, 338, 340–343, 70/358, 378, 421, 375, 382, 383

(56) References Cited

U.S. PATENT DOCUMENTS

| | | | | | |
|---|---|---|---|---|---|
| 1,232,035 | A | * | 7/1917 | Hurd | 70/341 |
| 1,785,634 | A | * | 12/1930 | Lawrence | 70/337 X |
| 1,788,834 | A | * | 1/1931 | Hurd | 70/337 X |
| 1,917,302 | A | | 7/1933 | Hill | 70/340 |
| 1,922,438 | A | * | 8/1933 | Hurd | 70/337 X |
| 2,008,405 | A | | 7/1935 | Schlage | 70/340 |
| 2,009,640 | A | * | 7/1935 | Stone et al. | 70/337 |
| 2,422,600 | A | | 6/1947 | Swanson | 70/340 |
| 2,427,837 | A | * | 9/1947 | Connell | 70/383 |
| 3,191,407 | A | * | 6/1965 | Spon | 70/383 |
| 3,348,392 | A | | 10/1967 | Schreiber | 70/358 |
| 3,713,310 | A | * | 1/1973 | Surko, Jr. | 70/337 X |
| 4,069,694 | A | | 1/1978 | Raymond et al. | 70/337 |
| 4,275,577 | A | * | 6/1981 | Castaldo | 70/337 |
| 4,376,382 | A | | 3/1983 | Raymond et al. | 70/338 |
| 4,631,941 | A | | 12/1986 | Sjunnesson | 70/337 |
| 5,000,019 | A | * | 3/1991 | Foster | 70/338 |
| 5,046,342 | A | * | 9/1991 | Urby | 70/337 |
| 5,176,015 | A | | 1/1993 | Sussina | 70/369 |

* cited by examiner

*Primary Examiner*—Suzanne Dino Barrett
(74) *Attorney, Agent, or Firm*—Kevin L. Daffer; Conley, Rose & Tayon P.C.; Marilyn S. Dawkins, IBM

(57) ABSTRACT

A master/valet lock and keyset provides a means of permitting limited one-time entry after locking a door to individuals possessing a valet key. In an embodiment, the mechanism relies on the use of a special master key to access a secondary lock cylinder, by means of which the full range of lock positions is allowed. Using the valet key, only the primary lock cylinder is accessed, restricting the range of positions to allow the user to unlock and relock the lock just once. This system may provide a means to allow occasional entry without granting unlimited access to the premises. For example, maintenance personnel could be given a valet key with which they could visit a home to perform repairs. The homeowner would be secure in the knowledge that the key could not be used to enter the home a second time.

14 Claims, 6 Drawing Sheets

MASTER/VALET KEYSET AND LOCK

BACKGROUND OF THE INVENTION

1. Field of the Invention

This invention is related to the field of lock mechanisms and, more particularly, to multiple-key lock mechanisms.

2. Description of the Related Art

There are many situations calling for limited access to a home or business, for example, by custodial or repair persons. In many such cases, one-time access may be all that is required. However, giving out a key in these situations grants unlimited entry and therefore compromises security. It would be desirable to have a means of locking a door that would allow one-time access to designated persons, and unlimited access to the owner.

Auto-makers have recognized the usefulness of this concept as applied to automobiles, and a number of currently-manufactured cars are equipped with master and valet keys, which differ in that the valet key provides limited access to the vehicle. For example, the glove compartment and trunk typically cannot be unlocked with the valet key. In some cases, the length of time the engine will operate when started with the valet key is also limited. However, such systems are not directly applicable to building access, where what must be restricted is not the number or type of doors that the valet key can unlock, but rather the number of times it can be used to open them. Furthermore, the access restriction systems used in automobiles are often electronic, and may become non-functional in the event of power loss. This is completely unacceptable in a building security system.

Key lock security systems exist based on master/service keys, which provide different levels of access. For example, a master key might allow a hotel manager to enter any of the rooms in a hotel, while the service key issued to a tenant permits entry only to the tenant's own room. U.S. Pat. No. 2,422,600 to Swanson, for instance, describes such a system. U.S. Pat. No. 4,631,941 to Sjunnesson (hereinafter, Sjunnesson) illustrates another variant of this idea. Sjunnesson describes a door lock that may be set in either a normal lock or a service lock position, depending on whether the occupant wishes to allow access by service personnel in his absence. The service key provided to janitorial staff in a hotel, for example, would work to unlock only those doors that had been left in the service lock position, thus restricting access. Neither of these simple master/service key arrangements, however, provides the advantage of limiting the service key to one-time access.

SUMMARY OF THE INVENTION

The problems outlined above are in large part solved by a master/valet keyset and lock as described herein. The mechanism comprises a lock that may be locked in either a master or a valet mode. Furthermore, the lock may be opened with either a master key or a valet key. These keys provide different levels of access. Using the master key, the lock can be locked and unlocked any number of times. Furthermore, when the lock has been locked in the master mode only the master key can be used to unlock it. When locked in the valet mode, the lock can be unlocked only once using the valet key. After it has been opened with the valet key and subsequently relocked, it can only be unlocked again by the master key. This system provides a means whereby the owner of the master key can permit one-time access to the building to an individual possessing a valet key, for example, a maintenance person. After the individual has entered the building using their valet key and relocked the door, only the master key will unlock the door again. Thus, if the valet key were to be lost or stolen it could not be improperly used to gain entry.

The master/valet keyset and lock may further comprise a turnstile system and a barrier pin. The turnstile system allows a valet key to turn in only one direction and the barrier pin prevents the valet key from rotating the lock from the valet locked position to the master locked position. Thus, a lock left in the valet lock position can be turned once to the unlocked position, and once more to the master locked position. At this point, the valet key is incapable of unlocking the door a second time; only the master key can restore the lock to the valet locked position. By this means, one-time access is provided to the holder of the valet key.

A method is also contemplated for locking a door in either a master mode or valet mode and for providing two types of keys, corresponding to these modes. The method further involves the use of a master key that can unlock the door and can lock it in either the master or the valet mode, and a valet key that can only lock the door in the master mode and can only unlock the door if it is locked in the valet mode.

It is considered advantageous to have the capability to lock a door in a limited access mode, whereby authorized individuals are allowed one-time access. This capability might serve well, for example, when it was necessary to enter an office after hours once each week, say, to collect waste paper for recycling. The individual performing this service would be issued a valet key, and on the day the collection service was to be performed the office door would be locked in the valet mode. Using the valet key, the office could be entered just once and relocked after collecting the papers. The valet key would not allow entry at any other time. Thus, even if the key were lost or stolen, the security of the office would not be seriously compromised.

BRIEF DESCRIPTION OF THE DRAWINGS

Other objects and advantages of the invention will become apparent upon reading the following detailed description and upon reference to the accompanying drawings in which.

Figure 1A:
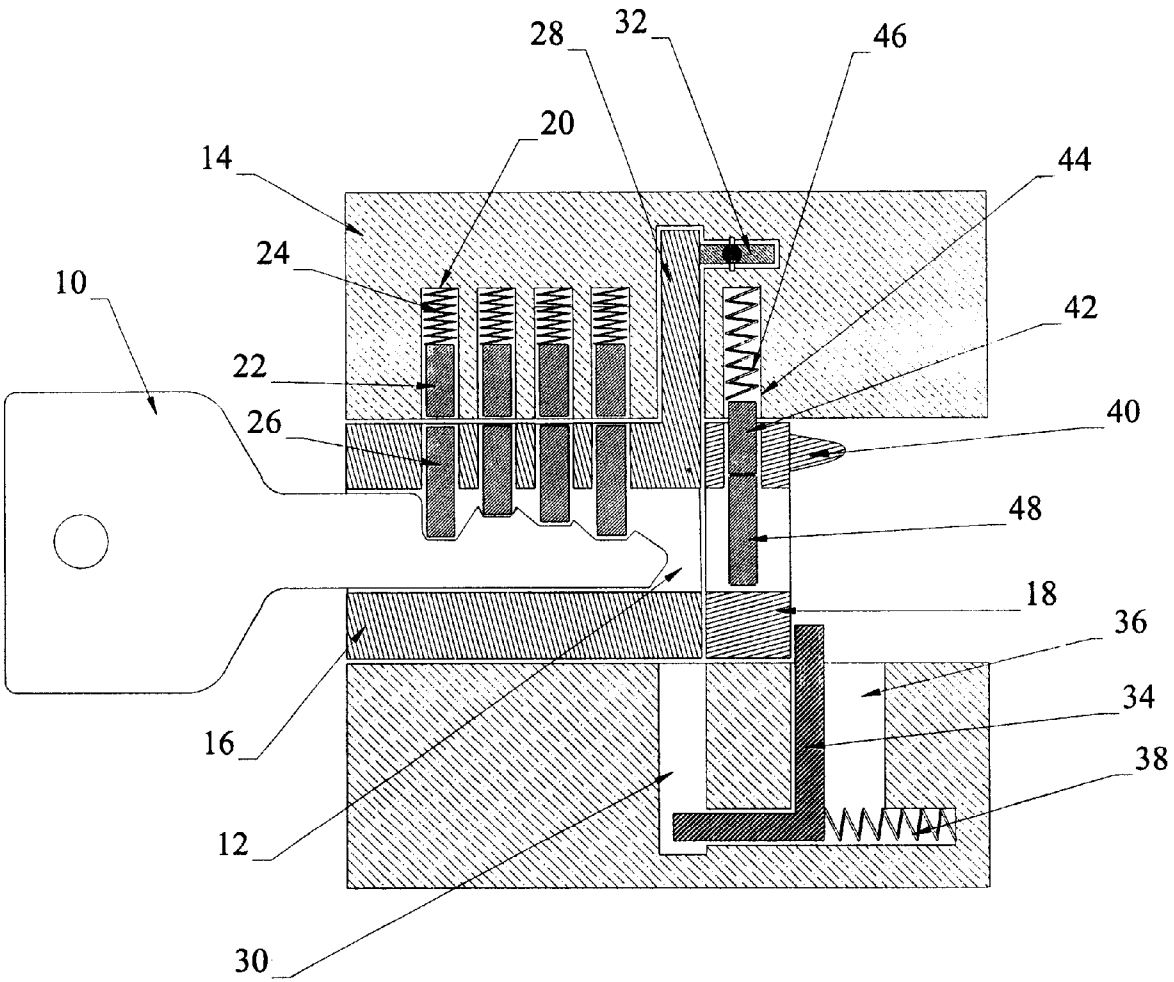
FIG. 1*a* is a cross sectional view of an embodiment of the master/valet lock, shown with the corresponding valet key inserted in the lock.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning now to FIG. 1*a*, a cross sectional view of one embodiment of a master/valet keyset and lock is shown. Other embodiments are possible and contemplated. The components of the lock are shown in FIG. 1*a* as they appear when a valet key 10 associated with the lock is inserted. A slot 12 in the primary lock cylinder 16 is dimensioned to receive the key.

Primary lock cylinder 16 is contained within the lock housing 14. Holes 20, typically cylindrical, in the lock housing contain lock tumblers 22, behind which are springs 24. Each of the tumblers 22 has a corresponding pin 26 within the lock cylinder 16. When a key is inserted into the lock, the notches on the key push pins 26 upward against the opposing force of the tumbler springs and displace the tumblers into their respective holes. If the notches are of the correct depth neither the tumblers nor the pins protrude from their holes, allowing the lock cylinder to turn within the lock housing; otherwise, the lock cylinder is prevented from turning. Although not explicitly shown, it should be understood that the cylinder is coupled to the lock bolt and, by rotating, can deploy the bolt to lock the door.

A preferred embodiment contemplated herein also comprises a secondary lock cylinder 18, with an associated tumbler 42, spring 46 and pin 48. In the embodiment of FIG. 1*a*, valet key 10 does not have an appropriately dimensioned notch for pin 48. Therefore, tumbler 42 protrudes into the hole in secondary cylinder 18, preventing rotation of the secondary cylinder. Appended to primary cylinder 16 may be an arm 28 extending into a circular cavity 30 within the lock housing 14. The cavity extends a full 360° within the lock housing to accommodate the arm as the primary cylinder rotates. In the embodiment of FIG. 1 however, primary cylinder 16 is constrained to rotate in one direction. One means of accomplishing this is through the use of turnstiles 32, which interact with the arm on the primary cylinder. However, other mechanisms, such as a ratchet system, might also be used. When the cylinder is rotated in the preferred direction the turnstile revolves, allowing the arm to pass. When the cylinder is rotated in the opposite direction, however, the turnstile blocks the arm. This mechanism is discussed further with reference to FIG. 2 below. Furthermore, a barrier 34 moving within a slot 36 in lock housing 14 may be thrust into circular cavity 30 by the action of a spring 38. This barrier blocks the arm 28, preventing rotation of the primary cylinder beyond a certain point in either direction.

In the embodiment of FIG. 1, secondary lock cylinder 18 is equipped with a protrusion 40 which can push barrier 34 back into slot 36 against the action of spring 38. For this to occur, secondary cylinder 18 must be rotated into the proper position. But, as previously noted, the valet key is not correctly notched to allow the secondary lock cylinder to rotate; therefore, the valet key cannot rotate primary lock cylinder 16 past the angle where arm 28 encounters barrier 34.

Figure 1B:
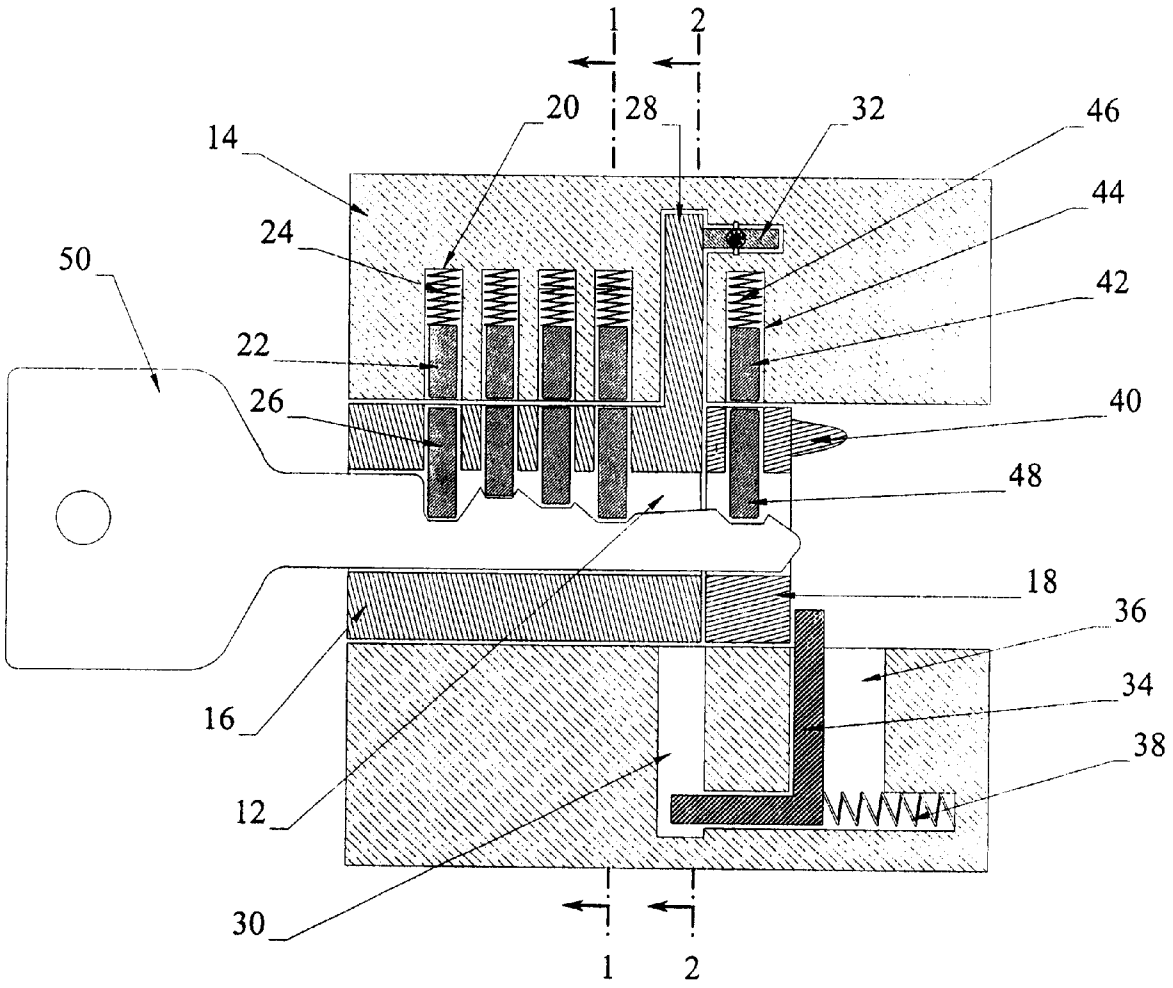
FIG. 1*b* is a view of the embodiment of FIG. 1*a*, but with the corresponding master key inserted.
Figure 1C:
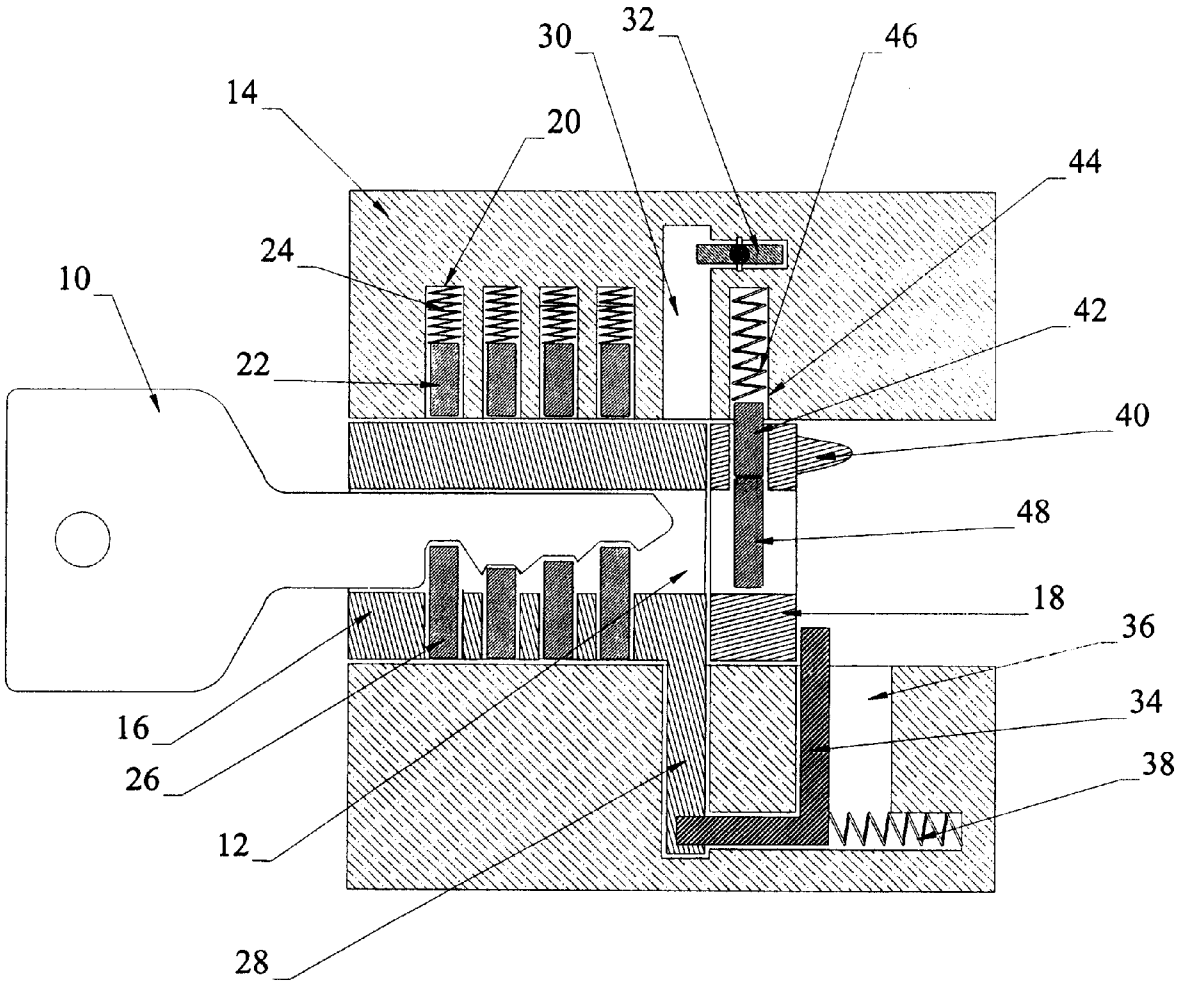
FIG. 1*c* is a cross section of the master/valet lock of FIGS. 1*a* and 1*b*, shown with the valet key inserted in the lock and turned approximately 180°.
Figure 1D:
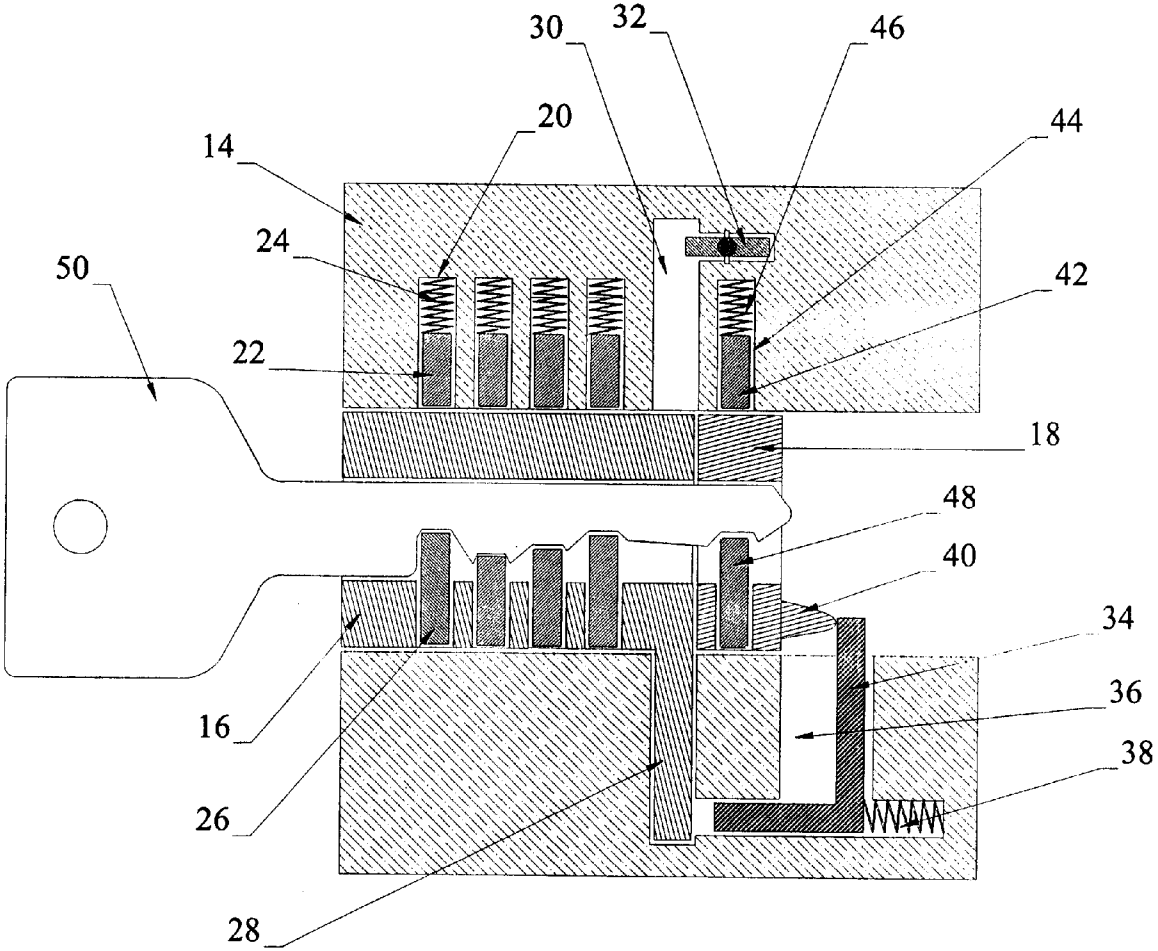
FIG. 1*d* is a view of the keyset and lock configured as in FIG. 1*c*, but with the master key inserted.

FIG. 1*b* illustrates the situation when the associated master key 50 is inserted into the lock of FIG. 1*a*. Note that, in contrast to valet key 10, master key 50 is extended to include a notched section for the secondary cylinder 18. The notch at the tip of the master key displaces pin 48, shoving tumbler 42 up into its hole 44, such that secondary cylinder 18 is free to rotate within the lock housing 14. As the master key is turned, both primary cylinder 16 and secondary cylinder 18 rotate together, and protrusion 40 rotates in conjunction with arm 28. Ann 28 is thus prevented from colliding with barrier 34 by the protrusion, which pushes the barrier back into slot 36 as the arm approaches it. FIG. 1*c* shows what happens in the embodiment of FIG. 1 when the valet key is used to attempt to rotate the primary lock cylinder 16 more than 180° within the lock housing 14. As the primary cylinder turns, arm 28 is blocked by barrier 34, which is thrust into circular cavity 30 by spring 38. The valet key can only be rotated in the opposite direction to the point where the arm encounters turnstile 32; consequently, 360° rotation is impossible. This is in contrast to the situation of FIG. 1*d*, where the master key 50 is used instead of the valet key. The notch at the tip of the master key displaces pin 48 in secondary cylinder 18 upward, preventing tumbler 42 from protruding from its hole 44 in the lock housing. This allows the secondary cylinder to rotate in conjunction with the primary cylinder. When the key is rotated 180°, protrusion 40 is positioned such that it is able to push back the barrier 34. With the barrier thus disabled, arm 28 is free to continue to turn the remaining 180°, accomplishing a full 360° of rotation.

Figure 2:
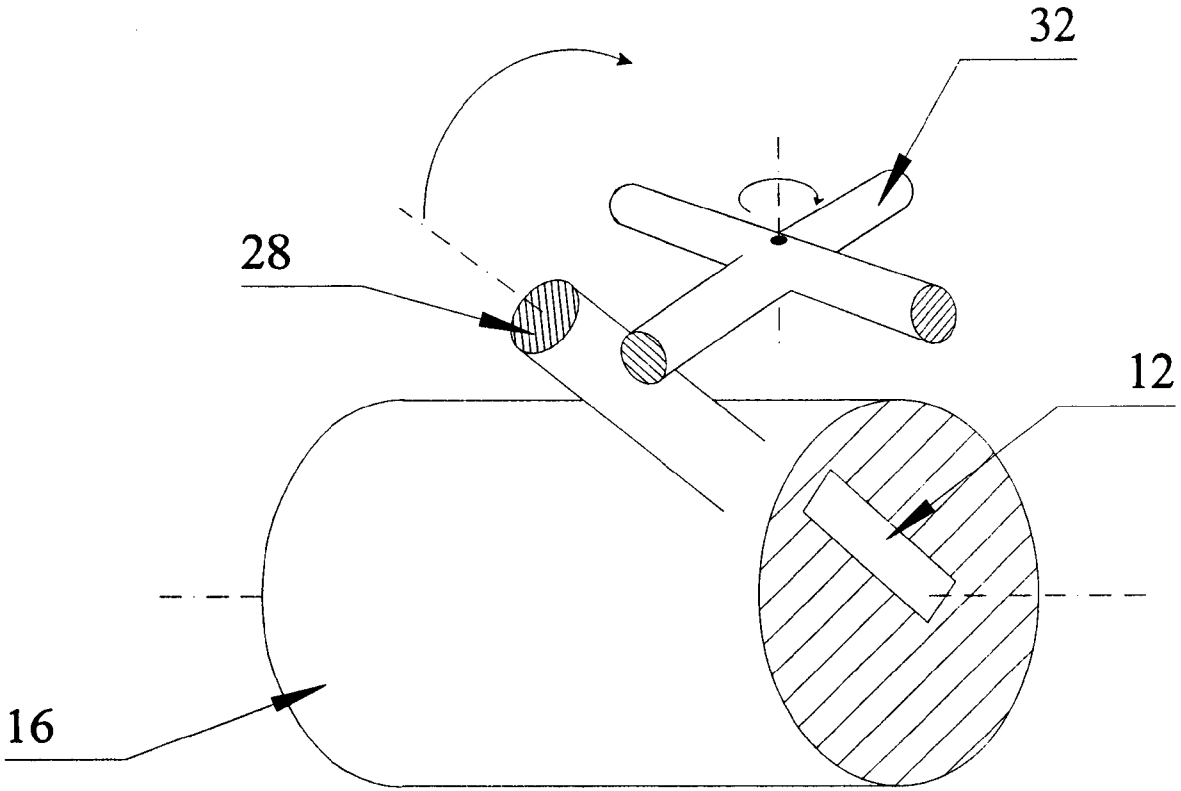
FIG. 2 is a detailed view of the primary cylinder and turnstile of FIG. 1, illustrating an embodiment of a method by which the primary cylinder is permitted to rotate in only one direction.

FIG. 2 illustrates how the direction of rotation of the lock is restricted in the embodiment of FIG. 1. Primary lock cylinder 16 is shown, with attached arm 28 and keyslot 12. In this view, the key would be inserted into the cylinder from the left. As the cylinder rotates in the direction indicated by the arrow, arm 28 encounters turnstile 32, which is designed to rotate only in the direction denoted by the smaller arrow. If the cylinder turns in the direction shown, it meets with no resistance from the turnstile. If it turns in the opposite direction, however, arm 28 is blocked by one of the turnstile arms. It should be noted that this particular configuration is merely one possible method of constraining the rotation of the cylinder, and other means could be adopted to achieve a similar effect.

Figure 3:
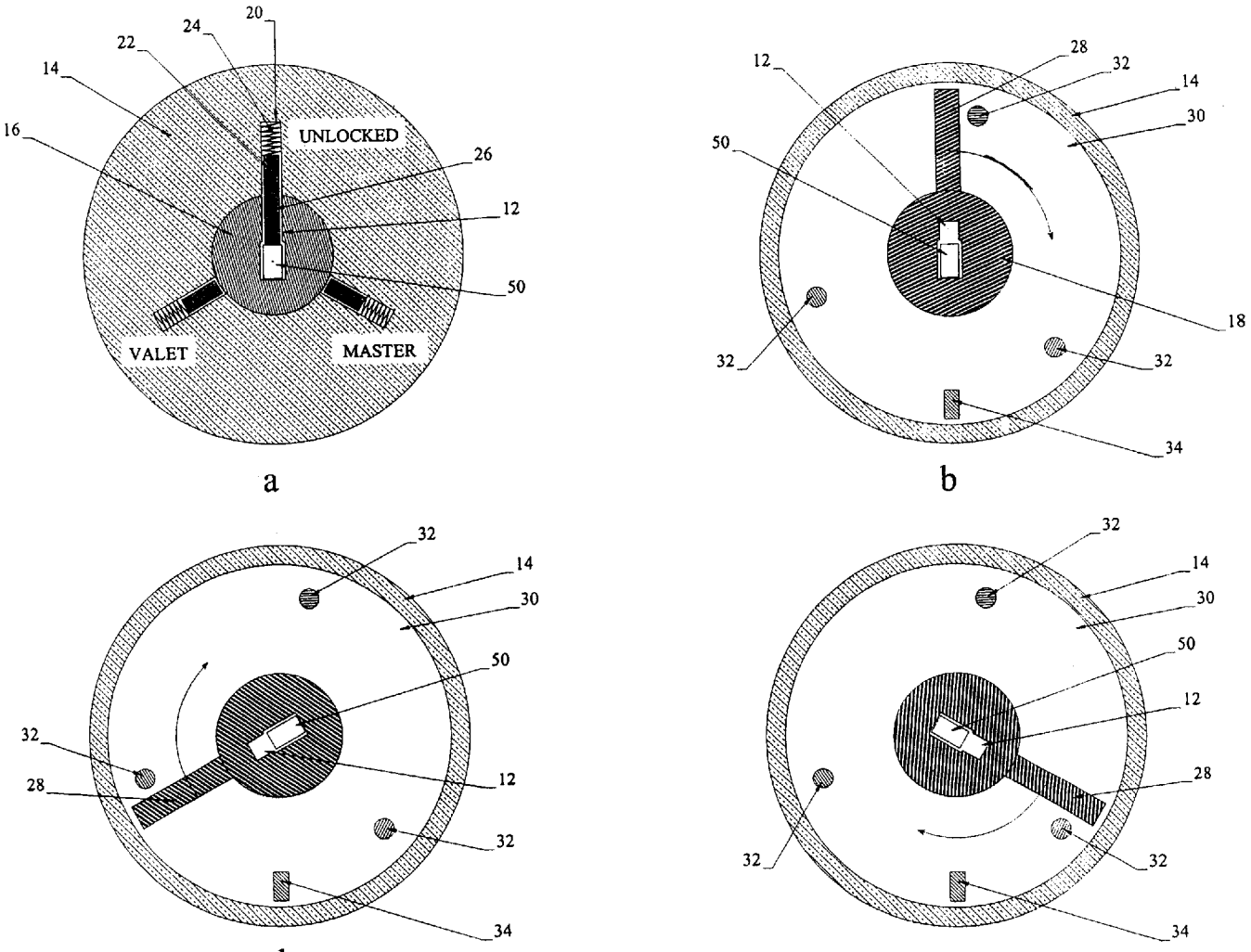
FIG. 3*a* is an end view of the main barrel of the keyset and lock of FIG. 1*b* along cross section 1—1 of FIG. 1*b*, illustrating the three positions (i.e., unlocked, valet locked and master locked) from which the key may be withdrawn from the lock.
FIG. 3*b* is an end view along cross section 2—2 of FIG. 1*b*, showing the arm on the main barrel of the lock, together with the turnstile system and barrier pin, and with the orientation of the arm corresponding to the unlocked position of the lock and the direction of rotation permitted by the turnstile system indicated by the arrow.
FIG. 3*c* is the same view as that of FIG. 3*b*, except that the arm is rotated into the master locked position.
FIG. 3*d* is the same view as that of FIG. 3*c*, except that the arm is rotated into the valet locked position.

FIG. 3*a* shows an end view along cross section 1—1 of FIG. 1*b*, displaying the lock housing 14 and primary cylinder 16. This perspective is as seen from the inner surface of the door. Tumblers 22, springs 24 and associated holes 20 are shown for three positions: unlocked, master locked and valet locked, and the lock is shown with master key 50 inserted in the unlocked position. Note that a key may be inserted or withdrawn from the lock only when it is in one of these three positions, which, for simplicity, are shown to be at 120° intervals. As discussed above, the notches on the key drive pins 26 upward to force the tumblers 22 into their respective holes 20, allowing the primary cylinder to rotate. FIG. 3*b* shows an end view along cross section 2—2 of FIG. 1*b*, displaying the secondary lock cylinder 18 and circular cavity 30, along with arm 28 and barrier 34. As before, the orientation of the components is for the unlocked position of the lock. Also shown are cross sections of three turnstiles 32, one for each of the three lock positions. The direction of rotation permitted by the turnstiles is indicated by a curved arrow, and corresponds to someone outside the door turning the key counterclockwise in the lock.

FIG. 3*c* shows the components of FIG. 3*b* with the lock in the master locked position. To reach the position of FIG. 3*c*, the secondary cylinder 18 has turned 120° and has passed the turnstile 32 at the upper right. Similarly, FIG. 3*d* shows the configuration of the lock components in the valet locked position. Note that in order to go from the master locked position to the valet locked position the arm 28 must pass by the barrier 34. As discussed above, this is accomplished when protrusion 40 displaces barrier 34, preventing it from interfering with the arm. This cannot happen when using the valet key, since the secondary cylinder 18 is not allowed to rotate in that case.

A typical sequence of events for operation of the lock begins with a master key-holder leaving the lock in the valet locked position. In this position the door is locked, but can be unlocked by a valet key. When the valet key is inserted, the mechanism described in the preceding paragraphs allows the lock cylinder to be rotated clockwise to the unlocked position. Upon leaving the premises, the valet key-holder may reinsert the valet key into the lock and turns it another 120° clockwise, placing it in the master locked position. Note that the valet key-holder cannot turn the key in the opposite direction to return to the unlocked position because of the turnstile system. Furthermore, the valet key cannot be turned an additional 120° clockwise to the valet locked position because of the barrier 34. Thus, the valet key lock system limits the valet key-holder to one entry. The master key-holder however, can turn the key a full 360° from any position, allowing him to lock the door in the either the master or valet locked positions.

Although the present discussion refers to a key inserted from the outside surface of the door, the mechanism described herein could be also combined with a thumbturn (or key) operating from the inside surface of the door. The components of the master/valet locking mechanism are preferably made of metal; however, other suitable materials may also be used. Other modifications, such as different angular orientations for the three locking positions, a different direction of rotation of the lock cylinder, or variations in the design, number or location of the turnstiles are also anticipated, and should be considered within the scope of the present invention.

It will be appreciated by those skilled in the art having the benefit of this disclosure that this invention is believed to present a system and method for implementing a master/valet keyset and lock. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. A method of enabling access to a door, said method comprising:

locking the door in a valet mode using a master key, wherein the valet mode is adapted to allow the door to be unlocked only once using a valet key;

unlocking the door using the valet key subsequent to said locking; and relocking the door into a master mode using the valet key, wherein the master mode is adapted to allow the door to be unlocked using the master key but not to be unlocked using the valet key, wherein said locking the door, unlocking the door and relocking the door all comprise turning the respective key in the same angular direction.

2. The method as recited in claim 1, wherein said locking the door in the valet mode comprises withdrawing the master key from a lock with the master key in a first angular orientation, and wherein said relocking the door into the master mode comprises withdrawing the valet key from the lock with the valet key in a second angular orientation.

3. The method as recited in claim 1, further comprising unlocking the door using the master key, subsequent to said relocking.

4. A locking mechanism, comprising:

a lock constrained to rotate in only one direction, and settable into an unlocked position, a master locked position or a valet locked position;

a master key adapted to set the lock in any of the three positions; and a valet key adapted to change the lock from the valet locked position to the unlocked position, or from the unlocked position to the master locked position.

5. The locking mechanism as recited in claim 4, wherein the master locked position is adapted to allow changing the lock to the unlocked position only by using the master key.

6. The locking mechanism as recited in claim 4, wherein the valet locked position is adapted to allow changing the lock to the unlocked position once by using the valet key.

7. The locking mechanism as recited in claim 4, wherein said lock comprises primary and secondary lock cylinders, both dimensioned to accept a key and turn within an outer housing.

8. The locking mechanism as recited in claim 7, wherein said secondary cylinder is dimensioned to receive the master key, but not the valet key.

9. The locking mechanism as recited in claim 7, wherein the direction in which the lock is constrained to rotate is limited beyond a specified angle.

10. The locking mechanism as recited in claim 9, wherein said rotational constraint comprises an arm attached to the primary cylinder, together with a turnstile system within said outer housing, such that said turnstile system interacts with said attached arm to permit rotation of the primary cylinder in only one direction.

11. The locking mechanism as recited in claim 10, wherein a barrier impedes rotation of the primary cylinder beyond a specified angle by blocking said attached arm.

12. The locking mechanism as recited in claim 11, further comprising an apparatus for overriding said barrier.

13. The locking mechanism as recited in claim 12, wherein said apparatus for overriding the barrier comprises a protrusion on the secondary cylinder, such that when the secondary cylinder is rotated along with the primary cylinder, said protrusion displaces the barrier and prevents the secondary cylinder form blocking the arm.

14. The locking mechanism as recited in claim 12, wherein the lock can only be changed from the master locked position to the valet locked position by overriding said barrier.

* * * * *